United States Patent [19]

Rizzo

[11] Patent Number: 4,593,274

[45] Date of Patent: Jun. 3, 1986

[54] REMOTE SIGNALLING APPARATUS, PARTICULARLY SUITABLE FOR REMOTE SURVEILLANCE PURPOSES

[75] Inventor: Corrado Rizzo, Montegrotto Terme, Italy

[73] Assignee: Veltronic S.p.A., Padua, Italy

[21] Appl. No.: 580,538

[22] Filed: Feb. 15, 1984

[30] Foreign Application Priority Data

Feb. 16, 1983 [IT] Italy ..... 84102 A/83

[51] Int. Cl.[4] ..... G08B 1/08

[52] U.S. Cl. ..... 340/539; 340/531; 455/89

[58] Field of Search ..... 340/539, 531, 506, 345; 455/73, 80, 89, 90, 9

[56] References Cited

U.S. PATENT DOCUMENTS 4,092,643 5/1978 Stolarczyk ..... 340/539
4,296,408 10/1981 Neuringer ..... 340/539
4,331,953 5/1982 Blevins et al. ..... 340/539

FOREIGN PATENT DOCUMENTS 2802075 7/1979 Fed. Rep. of Germany ..... 340/539

*Primary Examiner*—Donnie L. Crosland
*Attorney, Agent, or Firm*—Kimmel, Crowell & Weaver

[57] ABSTRACT

The present invention pertains to a remote signalling apparatus particularly suitable for remote surveillance purposes and provides direct signalling of occurred events via the actuation of optical and acoustic alarm reporting devices, and further provides for retransmission signalling of occurred events via the use of remote signalling systems of the radio-electronic transmission type and/or the telephonic transmission type. Apparatus is provided to detect and indicate the occurrence of a malfunction of a transmitter or receiver unit, while further providing irrefutable proof of occurred events by recording the occurrence of the same along with the date and time of such occurrence.

18 Claims, 5 Drawing Figures

FIG. 1.
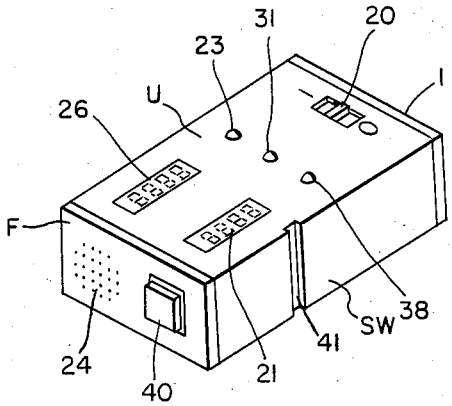
FIG. 2
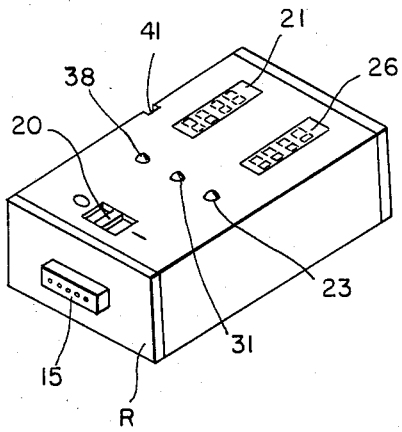
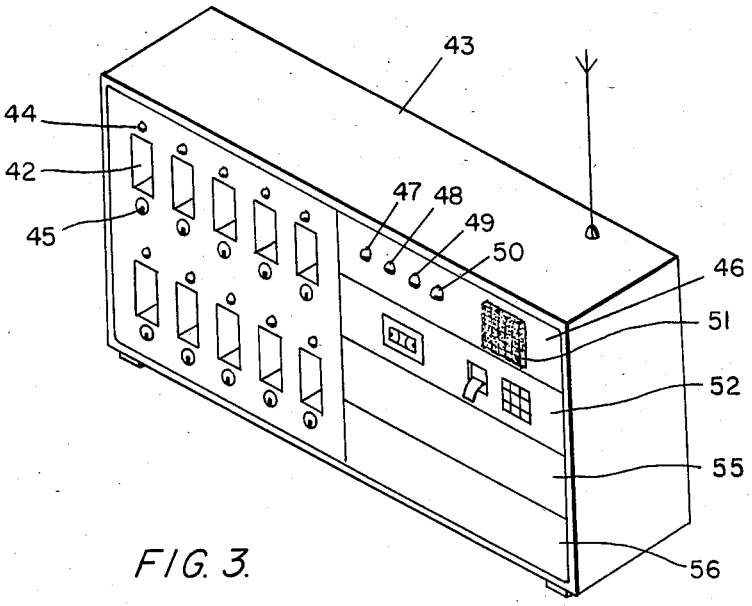
FIG. 3.

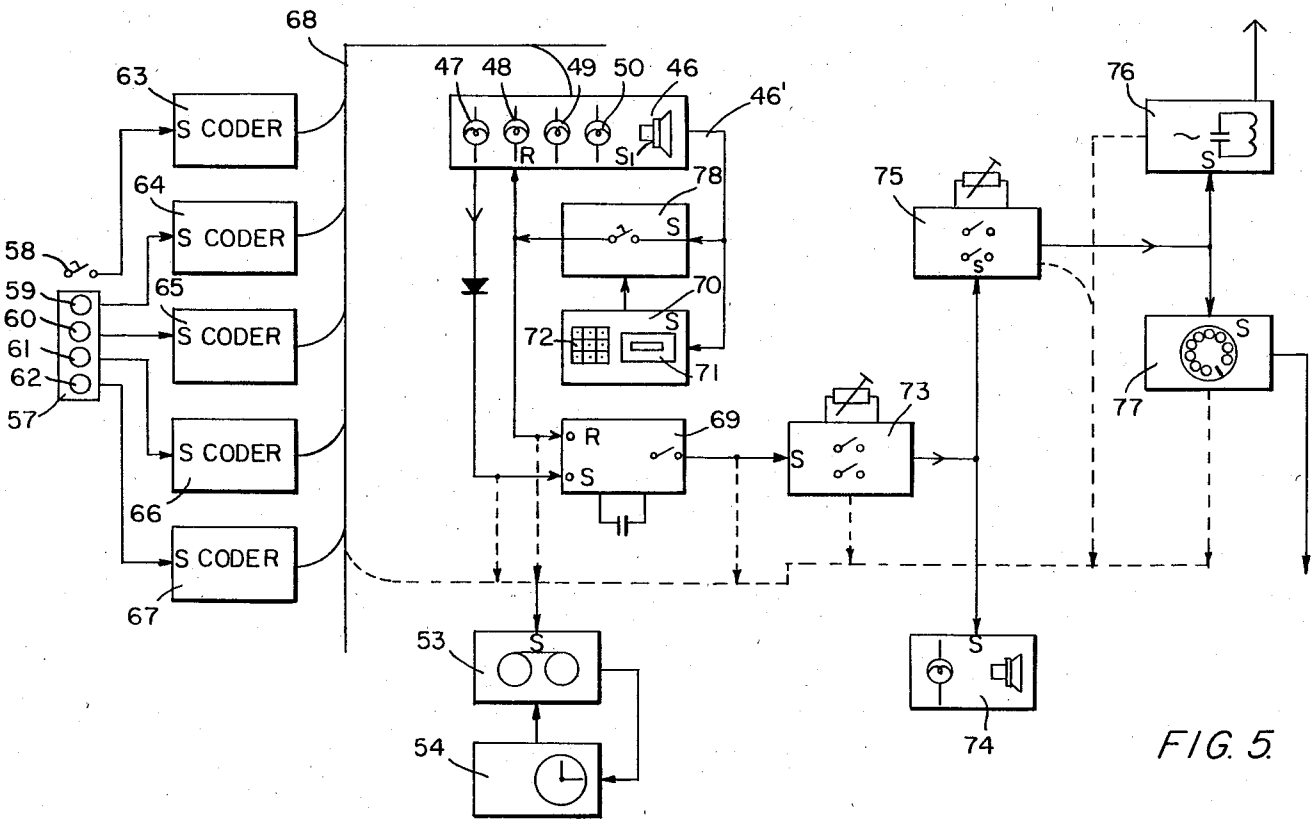
S CODER
S CODER
S CODER
S CODER
S CODER
S
R
S
R
S
S
S

REMOTE SIGNALLING APPARATUS, PARTICULARLY SUITABLE FOR REMOTE SURVEILLANCE PURPOSES

BACKGROUND OF THE INVENTION

This invention relates to a remote signalling apparatus, particularly suitable for remote surveillance purposes.

Apparatus are known are remotely signalling the occurrence of particular events to be monitored, such as a theft, tampering, kidnapping, a variation in certain environment conditions, etc.

These known apparatus normally comprise a transmitter, activated by one or more sensors which detect the occurrence of the event to be monitored, and one or more receivers which receive the signal from the activated transmitter. If, for example, the event to be monitored is the attempted theft of a watercraft, a transmitter of known apparatus is installed onboard the craft, the sensors are conventional devices which detect the intrusion of an intruder and/or an attempted theft, and the receiver is an apparatus tuned to the transmitter frequency. When the driver abandons or leaves the craft, he carries with him the receiver, and if an attempted theft or tampering with the craft occurs, he receives, via such receiver, a suitable signal from the transmitter. Known apparatus also provide for corresponding signals to be fed to fixed points (guardhouses, surveillance stations, police, etc.), in order to increase the reliability and timeliness of the intervention of guard personnel or of personnel entrusted with surveillance.

These known apparatus have proven to be considerably effective, in that they immediately indicate the occurrence of an undesirable event, and thus enable the person concerned to intervene without delay. However, they also have certain drawbacks, which mainly relate to an uncertainty in the attribution of responsibility where it has not been possible to prevent the undesirable event from occurring. In this respect, because of the fact that there is no check or determination of the actual moment in time at which most of such undesirable events occur, the only source of reference for such information is the word of the directly responsible person of concern. This can give rise to a whole series of disputes, which arise in view of the difficulty, and often the impossibility, of proving any statement of such person. Moreover, practical experience continuously shows that when the occurred undesirable event is covered by insurance, such disputes are greater, and thus, the smaller the possiblity of irrefutably providing the facts of the event.

There is, therefore, the problem of remotely transmitting a set of information in an unequivocal manner, and at the same time, of providing certain proof of the fact that this information has been correctly received and recognized by a person for whom it is intended, and even by another who replaces such a person during a normal shift of work covering such tasks and the responsibilities connected therewith.

Referring again to the already stated example, a case could be that of a pleasure craft which on being moored is entrusted to the custody of a harbor guard. Up to that moment of entrustment, the responsibility for the craft is obviously in the hands of the driver of such craft, whereas from that moment onward, the responsibility is transferred to the harbor guard, who, in the same manner as the driver, must be able to receive, from correctly operating apparatus, suitable signals as to when an undesirable event such as flooding, the commencement of fire, the entry of intruders, attempts to destroy or pilfer the cargo, attempts to remove the craft, etc., occurs. Each responsibile person must also, obviously, be in a position to determine from which of the crafts in his care the various signals originate.

SUMMARY OF THE INVENTION

The object of the present invention is to solve this problem and to provide a remote signalling apparatus which is able to provide: direct and retransmitted signalling of the events to be kept under surveillance, a self-checking signal and a signal indicating any erroneous operation of the apparatus, and proper and chronological documentation of the events which have occurred.

A further object of the invention is to provide an apparatus of simple installation, easy use and low cost.

These objects are attained according to the invention by a remote signalling apparatus particularly suitable for remote surveillance purposes and characterised by comprising: a receiver capable of receiving, in an unequivocal manner, coded signals originating from a transmitter unit being provided with sensors for detecting the events to be monitored, and further capable of providing alarm signals and signals indicating malfunction of the receiver and/or a transmitter system associated therewith; and a fixed unit for the supervision and operation of at least one receiver previously unequivocally coupled thereto, the fixed unit comprising:

- a compartment for housing, and mechanically locking therein each receiver;
- personalized means for releasing a mechanical lock means associated with said compartment, and for mechanically locking said receiver into said compartment;
- optical and acoustic alarm indicator means for indicating the occurrence of said signals indicative of a malfunction of each receiver and respective transmitter system, and/or for indicating the occurrence of said coded signals received by each receiver and originating from said respective transmitter;
- means for remotely retransmitting the occurrence of the said alarm signals and said signals indicating malfunction;
- means for recognizing an intended operator who is authorized to intervene following an indication by said fixed unit of a signal indicative of a detected event or malfunction relative to each receiver, whereby recognition of said operator enables the remote retransmission of said occurrence of the said signals to be suspended; and
- means for chronologically recording the occurrence of all of the indicated and signalled events of said apparatus.

Advantageously, the transmitter unit and a related receiver of the invention can be arranged to be initially activated simultaneously, but to only enter into effective operation after predetermined waiting times (T and T′ respectively, where $T<T'$) have transpired, and wherein the transmitter can operate to transmit a signal signifying that transmitter activation has occurred when its waiting time T has passed, since its activation.

Also according to the invention, the receiver can be provided with a first time counter (26) which totalizes the time which has passed since its activation or the time of activation of the receiver, and a second time counter (21) which totalizes the time which has passed since any receipt of an alarm signal.

Advantageously, the receiver of the apparatus according to the invention can be provided with a timer circuit (18) having: a delay equal to the predetermined waiting time T', a delayed set input (S) controlled by the activation of the receiver, and an instantaneous reset input (R) controlled by a coded first signal ($S_{3att}$) which signifies that the transmitter unit has been activated; the output of timer circuit (18) being connected to the second time counter (21) and to alarm indicators (i.e., 23 and 24).

Preferably, each receiver of the apparatus according to the invention can include a second timer circuit (17) which senses a coded alarm signal received from the transmitter, but not the before-mentioned coded signal ($S_{3att}$) which indicates that transmitter activation has occurred, and which has its output connected to the second time counter (21) and to alarm indicators (i.e., 23 and 24).

Advantageously, each receiver of the apparatus according to the invention can be housed in a casing provided with at least one notch (41) which, when the receiver is inserted into a compartment of the fixed supervision and operation unit (43), can be engaged by a compartment locking means (45) operable by a removable personalized key device.

Again according to the invention, each receiver and each compartment provided in the fixed unit can be provided with means (15, 57) for their mutual connection, in order to transfer, to the fixed unit, alarm signals and/or signals indicating the malfunction of the corresponding receiver inserted into the relative compartment.

Also according to the invention, the fixed unit (43) can include for each compartment a plurality of coder circuits for the signals of the events being monitored, the outputs of all of the coder circuits being connected to an indicator unit (46), for indicating the occurrence of the events, and to a recording unit (53).

Advantageously, the fixed unit of the apparatus according to the invention can be provided with a timer circuit (69) which is activated at its set input (S) by the circuit of the indicator unit (46) when an event being monitored occurs, and which timer circuit (69) is provided with a reset input (R) operable from the actions of an operator after he has been recognized by a recognition circuit (70).

Again according to the invention, the apparatus can comprise delayed alarm signal activator circuits (73, 75) activated by the timer circuit (69).

A preferred embodiment of the present invention is described hereinafter in detail by way of a non-limiting example and with reference to the accompanying drawings.

BRIEF DESCRIPTION OF THE DRAWINGS

FIG. 1 is a front perspective view of a portable receiver of the apparatus according to the invention;

FIG. 2 is a rear perspective view of the portable receiver depicted in FIG. 1;

FIG. 3 is a perspective view of a fixed supervision and operation unit with which the portable receiver of FIG. 1 can be associated;

FIG. 5 shows a functional block diagram of the fixed supervision unit of FIG. 3.

DETAILED DESCRIPTION OF A PREFERRED EMBODIMENT

Figure 4:
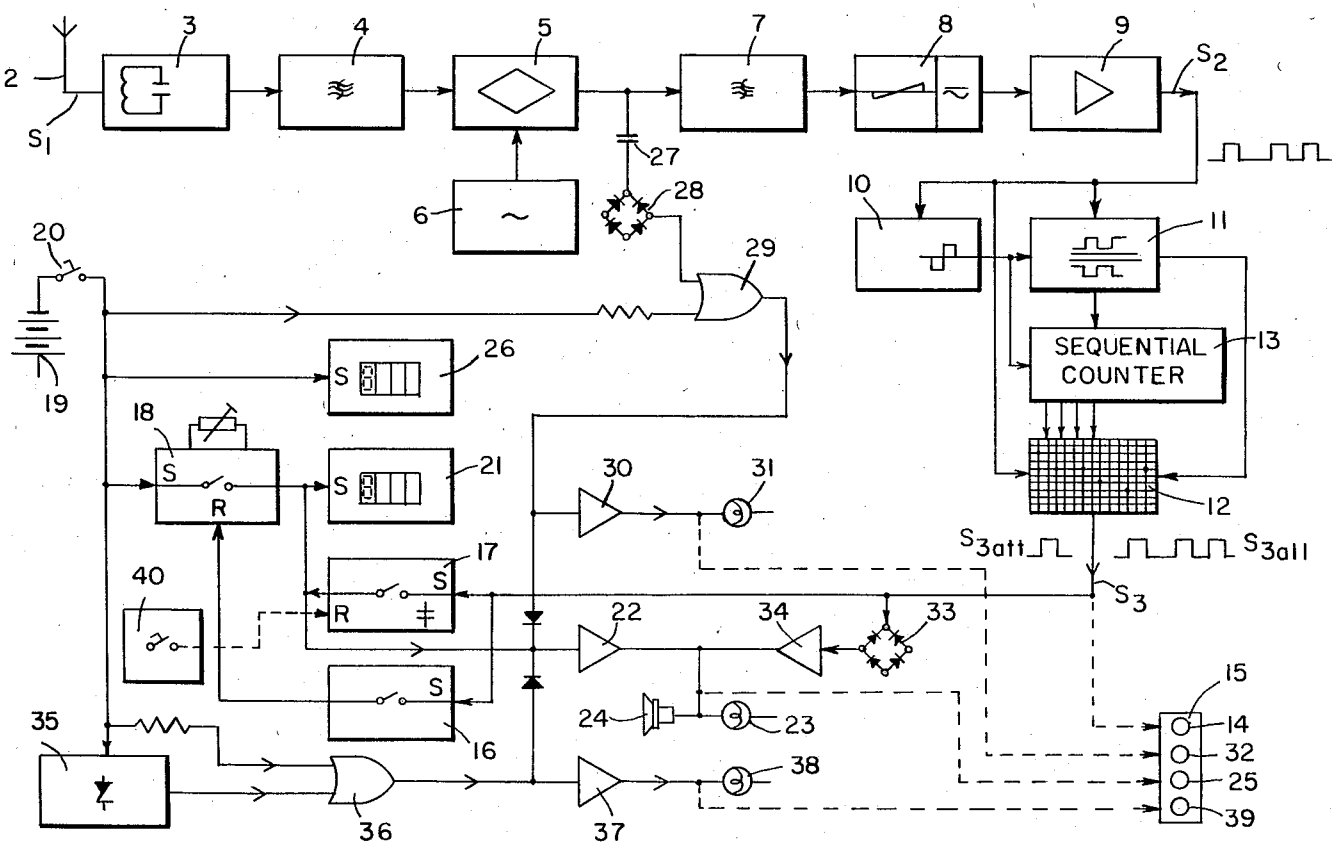
FIG. 4 shows a functional block diagram of the portable receiver of FIG. 1.

The apparatus according to the invention comprises a transmitter unit of known type, not shown in the drawings, which is installed, for example, on board a watercraft. Such transmitter is preferably of the type which can be activated by one or more sensors (thermal, magnetic, accelerometric, microwave, ultrasonic, etc.), which, in turn, can be activated by a particular event or events to be monitored. The apparatus according to the invention also comprises a receiver 1. In order to ensure certainty of connection between a transmitter unit and receiver 1, both can be provided with a programmable matrix, of known type, which enables the transmitter unit to transmit coded pulse trains of a required sequence, and which enables the receiver 1 to receive only coded pulse trains of the same sequence.

As shown in FIGS. 1 and 4, the receiver 1 comprises an antenna 2 for receiving the signal $S_1$ transmitted by the transmitter unit, and a resonant circuit 3 tuned to the frequency of the carrier wave of the signal $S_1$. The output of resonant circuit 3 is connected to the input of a bandpass filter 4, the output of which is connected to a mixer 5, to which there is also connected an output signal of a local oscillator 6. The output of the mixer 5 is connected to another bandpass filter 7, then to a demodulator 8 and then to an amplifier 9.

A signal $S_2$ constituted by a pulse train, corresponding to the code imposed on the transmitter unit, is provided at the output of the amplifier 9.

The output of the amplifier 9 is connected to a synchronization generator 10, an input of a serial data comparator 11, and the abscissa axis of a PROM memory device 12. The output of the sychronization generator 10 is connected to another input of the comparator 11 and to a sequential counter 13, to which the output of the comparator 11 is also connected. The outputs of the sequential comparator 13 are fed to the ordinate axis inputs of the PROM 12. The output signal $S_3$ of PROM 12 is connected to terminal 14 of a connector 15 provided on receiver 1, and to the inputs S of an instantaneous reset circuit 16 and a delayed reset circuit 17. The output of the instantaneous reset circuit 16 is connected to an input R of a timer 18, to which a power supply voltage means 19 of the receiver 1 is connected, such power supply voltage being switched on or provided, as shown, when a switch 20 is closed.

The output of the delayed reset timer circuit 17 is connected with the output of the timer 18 and to the input S of a counter 21, and to the input of amplifier 22 which is connected to an optical indicator 23, an acoustic horn 24 and terminal 25 of connector 15. The power supply 19 is also connected, as shown in FIG. 4, via switch 20, to a further counter 26, and, as set forth hereinafter, to other circuit devices to provide proper supply voltage thereto.

The output signal from the mixer 5 is connected via a decoupling capacitor 27 to a bridge rectifier circuit means 28, the output of which is connected to an input of NOR gate 29, the other input of which is connected to the power supply means 19, by way of closed switch 20. The output of the NOR gate 29 is connected, via amplifier 30, to a luminous indicator 31 and to terminal 32 of connector 15. The output of the NOR gate 29 is also connected to the input of the amplifier 22, via a diode means.

Output $S_3$ of PROM 12 is also shown connected, via rectifier circuit means 33 and an amplifier 34, to optical indicator 23, acoustic horn 24, and terminal 25 of connector 15.

The power supply 19 of receiver 1 is further connected, via the closed switch 20, to the input of a threshold indicator means 35, the input and output of which are connected to NOR gate 36. The output of NOR gate 36 is connected, via amplifier 37, to a luminous indicator 38 and to terminal 39 of connector 15, and also to the input of the amplifier 22 through a diode.

The herein-described receiver 1 is enclosed in a parallelepiped-shaped casing having provided on its upper surface U the above-mentioned switch 20.

The same upper surface U of the receiver 1 has mounted thereto the three luminous indicators 23, 31 and 38, which are preferably constituted by three LEDs, and also the displays of the two counters 21 and 26. The acoustic horn, graphically depicted as 24, and a reset pushbutton 40, used for interrupting the acoustic signal and for resetting the "stand-by" state of the receiver 1, are mounted on the front wall F, as shown in FIG. 1.

The rear wall R of the receiver 1 includes the connector 15, which, as stated above, includes the terminals 14, 25, 32 and 39.

A side wall SW of the receiver 1 includes a notch 41, the purpose of which, as further described hereinafter, is to allow mechanical locking of a receiver unit 1 into a compartment seat 42 of the fixed supervision and operation unit 43.

This unit 43, shown in FIGS. 3 and 5, comprises a parallelepiped-shaped casing in which there is provided a plurality of seats 42 for a like number of receivers 1. At each seat location there is provided a luminous indicator 44, constituted preferably a LED, and a mechanical lock means 45 preferably comprising a device operated by an extractable key, the lock means 45 acting on the notch 41 of a receiver 1, which has been previously inserted into the respective seat, so that a receiver can be locked into or released from a seat 42.

In addition to the apertures for the seats 42, the front wall of the casing of the unit 43 comprises:

- an indicator panel 46, containing four luminous indicators 47, 48, 49, 50 and an acoustic horn, graphically depicted at 51;
- a second panel 52 for covering a compartment (not shown) which houses a system 53 (for memorizing or recording all the information), a date and time generator 54, and a system for recognizing an operator of the unit 43;
- a third panel 55 for covering a compartment (not shown) housing a system for generating and externally transmitting warning signals;
- a fourth panel 56 for covering a compartment (not shown) housing the power supply for the unit 43.

On the end or back wall of each compartment 42 there is provided a connector 57 (see FIG. 5), into which the connector 15 of a corresponding receiver 1 can be inserted or plugged. The diagram of FIG. 5 also shows, in symbolic form, a switch 58 which is closed when the two connectors 15 and 57 become mutually engaged.

The terminals 14, 32, 25 and 39 of the receiver connector 15 connectably correspond respectively to the terminals 59, 60, 61 and 62 of the fixed unit connector 57, which latter terminals are connected, together with the switch 58, to five coders 63, 64, 65, 66 and 67, the outputs of which are multiplexed over a bus 68, which leads to the indicator panel 46.

The connections between the two connectors 15 and 57 are such that the operation of: luminous indicator 48 corresponds to that of the luminous indicator 31, the indicator 49 corresponds to that of the indicator 23, and the indicator 50 corresponds to that of indicator 38.

The output of the PROM 12 of FIG. 4 is also fed to the luminous indicator 47, via terminals 14 and 59, coder 64 and bus 68.

As shown in FIG. 5, the output 46' of the indicator panel 46 is connected to a reset circuit 78 for resetting said indicator panel 46. The output of circuit 78 is connected to a reset input of panel 46 and to a reset input R of a timer 69, and the set input S of this timer is connected to the output of the luminous indicator 47, via a diode.

The output 46' of indicator panel 46 is further connected to the input of a recognition circuit means 70, which comprises a badge reader 71 and a pushbutton panel 72. The output of recognition circuit 70 is connected, as shown, to reset circuit 78 to provide for its activation.

The output of timer 69 is connected to the input of an activator circuit 73, the output of which is shown to be connected to a device 74, comprising an optical indicator and a powered horn 74, and to a further activator circuit 75 which controls remote signalling systems 76 and 77 of the radio-electronic transmission type (76) or the telephonic transmission type (77).

The outputs of coders 63–67, inclusive, the luminous indicator 47, reset circuit 78, timer 69, activators 73 and 75, and remote signallers 76 and 77 are symbolically shown in dashed line form in FIG. 5 as being also connected to the before-mentioned recording/memorizing system 53 which is connected to and with a date and time generator means 54 for the purpose of chronologically recording the various sensed interventions and operations of the invention apparatus.

Assuming, for example, that when a transmitter unit associated with receiver 1 is installed onboard a watercraft, and the fixed supervision and operation unit 43 is installed on land in a guardhouse in a harbor, then the operation of such apparatus, according to the invention, is as follows.

While the driver is onboard the craft, the apparatus is in an unactivated state; when the driver departs or leaves the craft, he simultaneously activates the onboard transmitter unit and the receiver 1, which receiver he carries with him. After a predetermined waiting time T transpires, which is provided to allow him to leave the craft and to distance himself to a limited extend from it, the transmitter unit emits a single pulse train (activation signal), and thus becomes set into its alarm waiting state.

This pulse train, which is constituted by a carrier wave modulated by coded signals, is received by the antenna 2, selected by resonant circuit 3 and bandpass filter 4, and then fed to mixer 5, wherein a frequency signal generated by local oscillator 6 is mixed with the output of filter 4 in order to provide, at the output of mixer 5, a signal corresponding to the ratio of the two mixed signals.

This output signal of mixer 5 is selectively filtered through the bandpass filter 7, and demodulated in demodulator 8, which at its output provides only the modulating signal. This signal is amplified in amplifier 9 and outputted as the signal $S_2$ in the form of, i.e., 1-0 signals in sequential form, corresponding to the required coding.

Signal $S_2$ is then fed simultaneously to the: synchronizing generator 10, the purpose of which is to put the commencement and sequence of the messages in order; serial data comparator 11, the purpose of which is to compare the arriving data sequence of $S_2$ with the synchronizing signals originating from generator 10, and to direct the resultant data to the abscissa axis inputs of PROM 12; and sequential counter 13, which feeds the same data to the ordinate axis inputs of PROM 12.

In its turn, the PROM 12, as activated by the signal $S_2$ from amplifier 9, analyzes, one-by-one, the coincidence between the synchronous and sequential signals along its abscissa and ordinate axes, and only if the entire sequence is correct or coincides, in relation to that set in the PROM 12, does PROM 12 provide a signal $S_3$ as output, which in this case, is a single message signal.

If, instead of being the aforementioned single pulse train (activation signal), the signal fed by or emitted from the transmitter unit is a sequence of repetitive pulses, each pulse being similar to the prior-mentioned single pulse train, but repeated, the PROM device 12 provides at its output a signal $S_3$ which is a series of message signals (alarm signal) instead of a single message signal.

FIG. 4 graphically shows the $S_3$ activation signal configuration $S_{3att}$ and the $S_3$ alarm signal configuration $S_{3all}$, which are the respective output signals of PROM 12 resulting from the transmission of either a single pulse train or a sequence of repetitive pulses.

The signal $S_3$ leaving the PROM 12 is fed to the instantaneous reset circuit 16 and to the time delayed reset circuit 17.

In the meantime, the prior recited activation of the receiver 1 (by the closing operation of switch 20) has uncoupled the counter 26 and timer 18.

If signal $S_3$ outputted from PROM 12 is a short (activation) signal $S_{3att}$, it is "covered" by the delayed reset circuit 17 (17 not activated thereby), in that the delay of this circuit 17 is longer than the duration of signal $S_{3att}$; but, at the same time, $S_{3att}$ activates the instantaneous reset circuit 16 to zero the timer 18 and prevent it from providing an output signal to the counter 21 and amplifier 22.

However, if the signal $S_3$ is a long (alarm) signal $S_{3all}$, it activates the delayed reset circuit 17 to provide an output which activates counter 21 and via amplifier 22, luminous indicator 23 and acoustic horn 24.

In brief, from the instant of the activation of the apparatus of the invention, which takes place simultaneously for the transmitter unit and for the receiver, by the action of the driver of the watercraft when leaving the same, a certain waiting period passes which is shorter for the transmitter unit, but longer for the receiver 1. When the predetermined waiting time T of the transmitter unit has passed, the transmitter emits a short activation signal $S_{3att}$ which is insufficient to cause an alarm signal to be provided by the receiver, but allows the performance of an apparatus malfunction/correct operation function, which will be discussed hereinafter.

Thus, the transmitter unit is put or set into its waiting state wherein the transmitter will emit long alarm signals ($S_{3all}$) upon the detection of an occurrence of an event to be monitored by one of the sensors provided for and with the transmitter.

It should be noted that the waiting time T' of the receiver 1 is set into its timer 18, and as set forth above, T' must be greater than the predetermined waiting time T of the transmitter unit. Only in this case can the short activation signal $S_{3att}$, emitted by the transmitter unit, reach and be detected by the receiver 1 before its waiting time T' has passed, so that the signal $S_{3att}$ is not received as an alarm signal. In fact, this short signal $S_{3att}$ blocks the timer 18 (zeros the same to prevent output therefrom) by way of instantaneous reset circuit 16, and concurrently causes the emission of a very short optical-acoustic signal indicating correct apparatus operation, via rectifier 33, amplifier 34, indicator 23 and horn 24. Also, the signal output of amplifier 34 is also transferred, via terminals 25 and 61 of connectors 15 and 57, to the fixed unit 43.

If this short signal $S_{3att}$, used for indicating correct apparatus operation, is not properly detected by the receiver 1 within its predetermined waiting time T', the timer circuit 18 operates to provide an output which activates the luminous indicator 23 and the acoustic horn 24 in a manner so as to indicate a malfunction of either the transmitter unit or the receiver system. At this time, the output of timer 18 also activates the counter 21, which counter enables the time of the detected malfunction to be determined in an irrefutable manner.

Thus, the transmitter unit transmits two types of coded signals, one of which is a short (activation) signal $S_{3att}$, and the other being a long (alarm) signal $S_{3all}$.

The receiver 1 is also provided with two further functions, which are theoretically secondary to the essence of the invention, but which complete the operational configuration of the invention apparatus depicted in FIGS. 1–5. In this respect, a signal corresponding to the intermediate frequency signal, at the output of the mixer 5, is compared with a signal taken from the power supply 19 at the instant of the closure of the switch 20. If both of these signals are present, the NOR gate 29 (coincidence circuit means) gives no output signal; whereas, if one of these two input signals of NOR gate 29 is missing, i.e., the signal leaving the mixer 5, the NOR gate 29 operates to provide an output signal which activates luminous indicator 23 and acoustic horn 24, via amplifier 22, and luminous indicator 31, via amplifier 30.

In another alarm mode operation of the invention, if the actual level of voltage of the power supply voltage means 19 is lower than a predetermined minimum or low limit, which is set by threshold means 35 and below which correct operation of the receiver 1 is no longer guaranteed, NOR gate 36 detects the occurrence of this condition and provides an output which causes an alarm signal to be issued by the luminous indicator 38, via amplifier 37, and a malfunction signal alarm to be issued by luminous indicator 23 and acoustic horn 24, via amplifier 22.

When the driver of the watercraft wishes to leave the harbor area, he can entrust the supervision of his craft to a harbor guard and thus transfer to such party his supervisory responsibility, the harbor guard having installed in his guardhouse the fixed supervision unit 43. At such time, the driver would manually insert his receiver 1 into a free compartment or seat 42 of the unit 43 in the same manner as any other driver of other crafts, and thus insertably connect the connector 15 of his receiver 1 into the connector 57 provided in the end wall of such seat 42. The driver can then lock the receiver 1 in its seat 42 by operating the prior-mentioned mechanical lock means 45 which is controlled by a personalized and removably key means.

The insertion of the receiver 1 into a seat 42 causes closure of the switch contact 58, which action activates decoder 63 which, in its turn, causes a number to be recorded in the recording system 53 corresponding to the actual seat 42 being used by the receiver. This recording system of the invention also requests, from the generator 54, the date and time data relative to that particular message, in order to record such data with the corresponding seat number data.

The connection between terminals 32 and 60 of the respective connectors 15 and 57 affords the transfer of an output (malfunction alarm) signal from amplifier 30 of the receiver to the fixed unit 43.

This output signal, representative of a malfunction of the receiver 1, activates coder 65 to provide an output alarm signal to the indicator panel 46 and to the recording system 53, which system 53 records or memorizes it together with the relative date and time data transmitted by the generator 54.

The connection between terminals 39 and 62 of the respective connectors 15 and 57 affords the transfer of an output (malfunction alarm) signal from the amplifier 37 to the fixed unit 43. The detection of an excessively low voltage of the receiver power supply 19 can be recorded in fixed unit 43 via coder 67 and recording system 53 together with data from date/time generator 54.

The connection between terminals 25 and 61 of the respective connectors 15 and 57 affords the transfer of an output alarm signal from the amplifier 22 to the fixed unit 43. Accordingly, if the receiver 1 has received a long (alarm) signal $S_{3all}$, or has not received a short (activation) signal $S_{3att}$ (and in accordance with the foregoing description, counter 21 has been activated), a correspondingly representative signal is recorded in recording system 53 with the relative date/time data. This output signal of amplifier 22 is also outputted to and reaches the indicator panel 46 for the activation of the luminous indicator 47, the signal output of which is connected to the timer 69, the use of which being set forth hereinafter.

In all cases for which the panel 46 provides a luminous and/or acoustic alarm indication, the intervention of an intended and responsible person is required in order to deactivate these alarm indications. Such party would effect "recognition" by firstly making himsself recognized by the recognition circuit 70 by the means of a personal coded badge and a pre-arranged code or cipher, by respectively using the badge reader 71 and the pushbutton panel 72 devices. If such coded data is correctly identified by circuit 70, "recognition" occurs and a resultant output signal of circuit 70 activates the reset circuit 78 which zeros the indicator panel 46 (resets to deactivate the indicators of panel 46) and resets the timer 69, which action enables the remote retransmission of occurred/detected events to be suspended. At the same time, the "recognition" output signal is recorded in memory system 53 together with the date/time data of the event. If, however, "recognition" does not occur, the indicator panel 46 is not zeroed and the timer 69 proceeds to time out and allow the remote retransmission of occurred/detected events to continue, until it reaches the end of its preset waiting time, after which timer 69 causes the activator circuit 73 to intervene and control the activation of the optical indicator and power horn device 74, which is normally installed outside of the guardhouse. At the same time, activator 73 causes a further activator means 75 to intervene and activate after the end of its preset waiting time the remote signalling systems 76 and 77, which, as presented hereinabove, are of the radio-electronic transmission type or the telephonic transmission type respectively, to provide for the retransmission signalling of an occurrence of an event being monitored by the apparatus of the present invention.

Therefore, in accordance with that set forth above, the apparatus of the invention provides for direct signalling of occurred events, via indicator panel 46 and/or device 74 or the prior-mentioned optical and acoustic indicator means, and further provides for retransmission signalling of occurred events via remote signalling systems 76 and 77; and means are provided to detect and indicate the occurrence of a malfunction of a transmitter or receiver unit, while further including means for providing irrefutable proof of occurred events by recording the occurrence of the same along with the date and time of such occurrence.

I claim:

1. A remote signalling apparatus particularly suitable for remote surveillance purposes and characterized by comprising: a receiver (1) capable of receiving coded signals originating from a transmitter unit being provided with sensors for detecting the occurrence of events to be monitored, and further capable of providing alarm signals and signals indicating malfunction of said receiver and said transmitter unit associated therewith; and a fixed unit (43) for the supervision and operation of at least one said receiver coupled thereto, said fixed unit comprising:

a compartment (42) for housing, and mechanically locking therein, each said receiver;

personalized means for releasing a mechanical lock means (45) associated with said compartment and for mechanically locking said receiver unit into the said compartment;

optical and acoustic alarm indicator means (46) for indicating the occurrence of said signals indicative of a malfunction of each said receiver and respective transmitter unit and/or for indicating the occurrence of said coded signals received by each said receiver and originating from said respective transmitter;

means (76, 77) for remotely retransmitting the occurrence of the said alarm signals and said signals indicating malfunction;

means (70) for recognizing an intended operator who is authorized to intervene following an indication by said fixed unit of a signal indicative of a detected event or malfunction relative to each said receiver, whereby recognition of said operator enables the remote retransmission of said occurrence of the said signals to be suspended; and means (53, 54) for chronologically recording the occurrence of all of the indicated and signalled events of said apparatus.

2. An apparatus as claimed in claim 1, characterized in that said transmitter unit and a related said receiver are arranged to be activated simultaneously but to only enter into effective operation after predetermined waiting times (T and T′ respectively, wherein $T<T'$) have transpired, and wherein the said transmitter operates to transmit a coded first signal signifying that transmitter activation has occurred, when its waiting time (T) has passed since its activation.

3. An apparatus as claimed in claim 1, characterized in that said receiver includes a first time counter (26) which totalizes the time which has passed since its activation, and a second time counter (21) which totalizes the time which has passed since any receipt of a coded alarm signal transmitted from said transmitter.

4. An apparatus as claimed in claims 1 or 2, characterized in that the said receiver further includes a timer circuit (18) having: a delay equal to a predetermined waiting time (T') of the said receiver, a delayed set input controlled by the activation of said receiver, and an instantaneous reset input controlled by a coded first signal signifying that transmitter activation has occurred.

5. An apparatus as claimed in claims 1 or 2, characterized in that each said receiver includes a delayed reset timer circuit (17) which senses a coded alarm signal received from said transmitter, but not a coded first signal signifying that transmitter activation has occurred.

6. An apparatus as claimed in claim 1, characterized in that each said receiver further includes a coincidence circuit means (29) which receives at its inputs an output signal from a mixer (5) and a signal originating from a power supply means (19) of said receiver, and which has its output connected to a malfunction indicator means (31).

7. An apparatus as claimed in claim 1, characterized in that each said receiver is provided with a coincidence circuit (36) which receives at its inputs a signal originating from a power supply means of said receiver and a signal originating from said power supply (19) via a threshold indicator means (35) connected therewith, and which has its output connected to a malfunction indicator means (38).

8. An apparatus as claimed in claim 1, characterized in that each said receiver is housed in a casing provided with at least one notch (41) which, when a receiver is inserted into a compartment (42) of said fixed supervision and operation unit (43), can be engaged by a locking member of said mechanical lock means which is operable by a removable and personalized key device.

9. An apparatus as claimed in claim 1, in that each said receiver and each said compartment provided in said fixed unit are provided with a connector means (15, 57) for their mutual connection in order to transfer from said receiver and to said fixed unit alarm signals and/or signals indicating the malfunction of said receiver inserted into said related compartment.

10. An apparatus as claimed in claims 1 or 9, characterized by being provided with means (63) for producing a signal each time a said receiver is inserted into and connected with a said compartment.

11. An apparatus as claimed in claims 1 or 9, characterized by comprising for each said compartment a plurality of coder means (63, 64, 65, 66, 67) operative by the signals of the events being monitored, the outputs of all said coder means being connected to an indicator unit (46) of said fixed unit for indicating said events, and to said recording means (53, 54).

12. An apparatus as claimed in claims 1 or 9, characterized by including in said fixed unit an indicator unit (46) which is provided with indicators for occurred events and/or malfunctions corresponding to those present in each said receiver, said fixed unit further including an indicator means (44) to indicate that a receiver has been inserted into a compartment.

13. An apparatus as claimed in claim 1, characterized by said fixed unit being provided with a timer means (69) which is activated by a circuit means of an indicator unit (46) of said fixed unit when an event being monitored occurs, said timer means being provided with a reset input operable by said means for recognizing an intended operator.

14. An apparatus as claimed in claim 13, characterized by the said means for recognizing an intended operator being operable upon recognition cf an intended operator to activate a reset circuit means (78) to reset said indicator unit (46) and said timer means (69), whereby recognition of said operator enables the remote retransmission of said occurrence of the said signals to be suspended.

15. An apparatus as claimed in claim 1, characterized by including a timer means (69) and delayed activator circuit means (73, 75) with said means (76, 77) for remotely retransmitting the occurrence of the said signals, said delayed activator circuit means being operable or activated by said timer means to control the operation of said remote retransmitting means (76, 77).

16. An apparatus as claimed in claim 3, characterized in that the said receiver further includes a timer circuit (18) having: a delay equal to a predetermined waiting time (T') of the said receiver, a delayed set input controlled by the activation of said receiver, and an instantaneous reset input controlled by a coded first signal signifying that transmitter activation has occurred, the output of said timer circuit being connected to said second time counter (21) and to alarm indicators (23, 24) of the said receiver.

17. An apparatus as claimed in claims 3 or 4, characterized in that each said receiver includes a delayed reset timer circuit (17) which senses a coded alarm signal received from said transmitter, but not a coded first signal signifying that transmitter activation has occurred, and which has its output connected to a second time counter (21) and to alarm indicators (23, 24) of the said receiver.

18. An apparatus as claimed in claim 1, characterized by including a timer means (69) with said means (76, 77) for remotely retransmitting the occurrence of the said signals, and a reset circuit means (78) for an indicator unit (46) of said optical and acoustic indicator means, wherein said means (70) for recognizing an intended operator is operable upon recognition of said intended operator to activate said reset circuit means to reset said indicator unit and said timer means.

* * * * *